United States Patent [19]

Richards

[11] 4,261,573

[45] Apr. 14, 1981

[54] GOLF SWING SIMULATOR DEVICE

[76] Inventor: Ralph H. A. Richards, 20 Homestead Gardens, Frenchay, Bristol BS16 1PH, England

[21] Appl. No.: 94,856

[22] Filed: Nov. 16, 1979

[30] Foreign Application Priority Data

| | | | |
|---|---|---|---|
| Nov. 17, 1978 | [GB] | United Kingdom | 45062/78 |
| Dec. 1, 1978 | [GB] | United Kingdom | 46816/78 |
| Jun. 11, 1979 | [GB] | United Kingdom | 20212/79 |

[51] Int. Cl.[3] ..... A63B 69/36

[52] U.S. Cl. ..... 273/191 R; 273/193 R

[58] Field of Search ..... 273/186 R, 186 A, 191 R, 273/191 A, 191 B, 192

[56] References Cited

U.S. PATENT DOCUMENTS

| | | | |
|---|---|---|---|
| 1,983,920 | 12/1934 | Perin | 273/191 R |
| 3,876,212 | 4/1975 | Oppenheimer | 273/191 R X |

FOREIGN PATENT DOCUMENTS

| | | | |
|---|---|---|---|
| 597724 | 2/1948 | United Kingdom | 273/191 R |
| 1009090 | 11/1965 | United Kingdom | 273/191 R |
| 1144180 | 3/1969 | United Kingdom | 273/191 R |

*Primary Examiner*—George J. Marlo

*Attorney, Agent, or Firm*—Larson, Taylor and Hinds

[57] ABSTRACT

A golf swing simulator device comprises a handle (10) or a mounting therefor, rotatably (axis 34) mounted to a crank (22) which is in turn rotatably (axis 28) connected (30) via hinged (36) interconnecting elements (21,23) to the outer end of an adjustable arm (20), the inner end of which is rotatably connected (axis 26) to a first part (16) of a mounting for the device. The first part (16) angularly adjustably mounted to a second part (14) which is in turn vertically adjustably mounted to a fixed support (12). This provides three rotational modes A,B,C to enable the golf swing to be simulated using the handle (10); and four adjustments D, E, F, G to determine the standing height, plane of swing, radius of swing and lie angle respectively.

7 Claims, 2 Drawing Figures

GOLF SWING SIMULATOR DEVICE

This invention relates to equipment for practising the game of golf. More particularly, it seeks to provide a device by which a golf swing can be simulated in a predetermined reproducible and repetitive manner.

A number of golf swing simulator devices have been proposed in the past; for example as in U.K. Specifications Nos. 1500322, 1258018, 1144180, 1009090 and 597724. Of these, 1009090 and 1144180 show a device comprising a golf club mounted by a crank which is pivotally connected to one end of an arm about a pivot axis which extends through the handle in the region assumed by the hands. The other end of the arm is pivoted about another axis to a mount which is vertically adjustable on a support such as a wall or post. The two axes are fixed relative to one another, and appear to be generally parallel to each other. The length of the arm is adjustable to vary the distance between the axes, so that, as stated in No. 1009090, the two axes can pass one through the hands of the user and the other through his hips. The angle which the axes make with the horizontal can be adjusted in No. 1009090 to change the plane of swing. In No. 1144180 the pivot at the upper end of the arm provides a further, horizontal, pivot axis which changes the plane of swing at the upper ends of the swing, but the basic plane of swing at the bottom is not adjustable. Thus the degrees of adjustment are limited and the plane of swing is not closely controlled throughout. In No. 1009090 the plane of swing is closely controlled, but any adjustment of the plane of swing alters the lie angle of the club. No. 597724 shows a device in some respects similar to that described above, but with a universal joint between the crank and the arm, so that the lie angle is not controlled except by contact of the club with the ground, and the attitude of the club during the swing is not controlled at all.

The present invention provides a golf swing simulator device comprising a handle or mounting for a handle representing that of a golf club, attachment means for mounting the device to a stationary support, and a linkage connecting the handle with the attachment means, the linkage comprising an arm pivotally mounted at one end to the attachment means about a first axis, the arm extending away from said axis so that on pivoting the other end of the arm describes a circle about said first pivot axis, a crank one end of which is connected with said other end of the arm through a pivotal connection having a second axis of rotation preferably coplanar with but spaced from said first axis and the other end of which is rotatably mounted to the handle about the longitudinal axis of the handle so that the handle projecting from the crank is spaced from said pivotal connection in line with said second axis, means for adjusting the effective length of the arm or the angle between the arm and the first axis, means for adjustment of the angle that said first pivot axis makes with the horizontal, characterised in that the device includes means whereby the angle between said first and second axes can be adjusted.

The device simulates the golf swing through the hands of the user by controlling the position of the hands through the predetermined course of a full golf swing and by allowing the wrists and hands to move (break and rotate) in a natural and recognised manner. The control and movement is mechanically imposed and allowed by the device which is anchored to a stationary support facing the user and in a position above the natural lower position of the user's hands. The axis of swing need not pass through the hips of the user, and is not in permanent angular relationship to the angle of rotation of the hands. Moreover the lie angle of the club can be adjusted independently of all the other adjustments.

In order that the invention may be more clearly understood, two embodiments will now be described with reference to the accompanying drawings, wherein.

Figure 1:
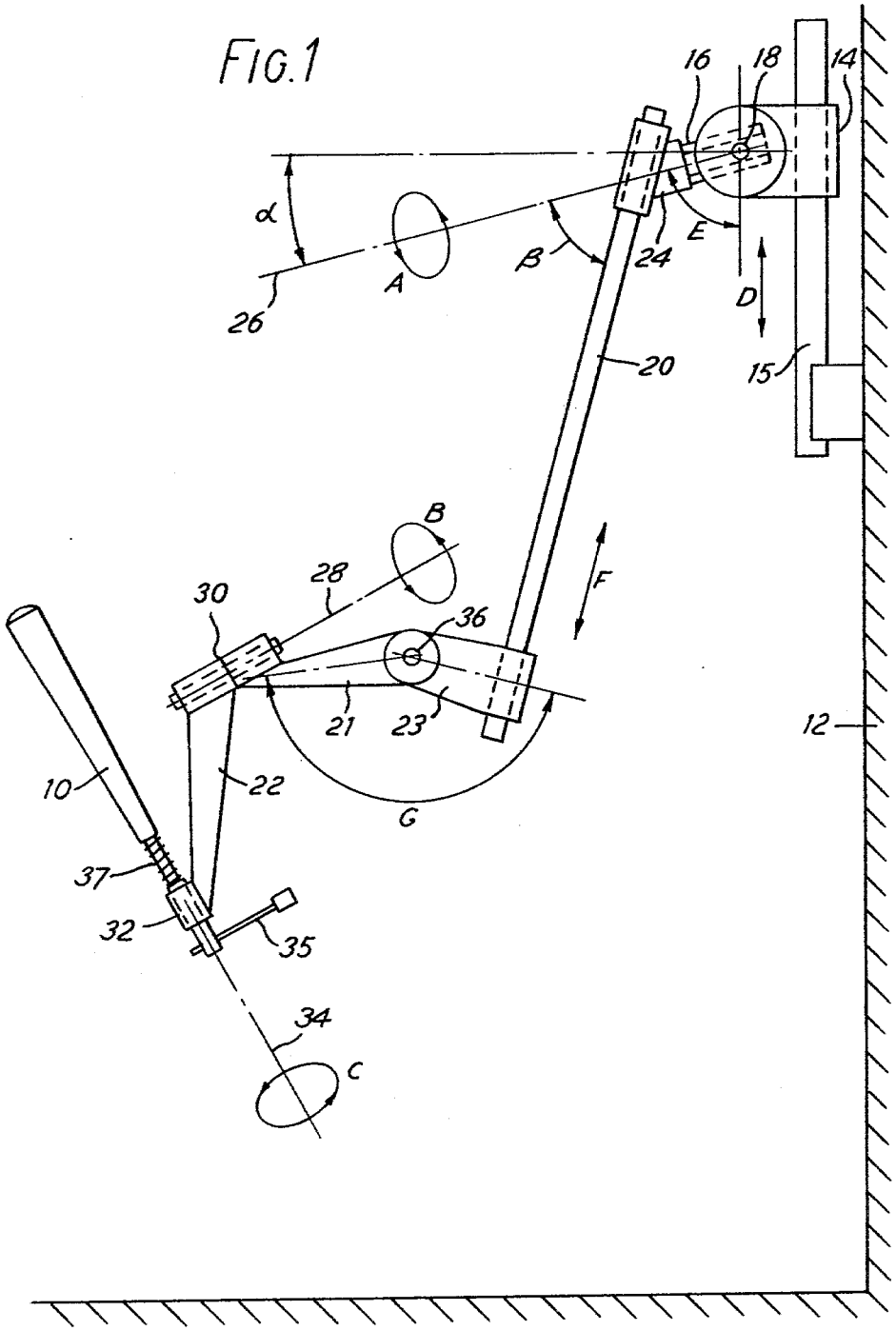
FIG. 1 shows a diagrammatic side view of one embodiment of the device.

Referring to FIG. 1; the device comprises a handle 10 representing that of a golf club, and a linkage connecting the handle with attachment means for mounting the device to a fixed vertical support such as a wall 12. The attachment means comprises a bracket 14 vertically adjustably mounted to a slide 15, and an angularly adjustable part 16 which is mounted to the bracket 14 about a horizontal pin 18 which extends parallel to the wall. The pin is associated with a screw or other mechanism (not shown) whereby the part 16 can be clamped to the bracket against pivotal movement when it is at a desired setting.

The linkage which joins the part 16 to the handle 10 includes an arm 20 and a crank 22. The arm incorporates a head 24 at one end through which it is journalled to the part 16 about an axis 26 which makes an angle $\alpha$ with the horizontal, the angle $\alpha$ being adjustable at the pivot pin 18. The other end of the arm is connected with one end of the crank 22 through a pivotal connection 30, so that the crank is rotatable about an axis 28. The pivotal connection 30 is joined to the arm 20 through a pair of connecting elements 21,23 adjustably interconnected at 36 so that the angle between the axis 28 and the axis 26 can be varied. The other end of the crank is journalled at 32 to the lower end of the handle 10 so that the handle is rotatable relative to the crank about the longitudinal axis 34 of the handle. It will be seen from FIG. 1 that the axes 28 and 34 intersect, preferably at about 90°, but that the handle is spaced from the pivotal connection 30. If desired, a further angularly adjustable connection can be provided at the head end of the arm 20, for example in the head 24, so that the angle $\beta$ between the axis 26 and the arm can be adjusted. Preferably, however, the effective length of the arm 20 is adjustable, for example by having the position of the head 24 or connecting element 23 or both adjustable along the arm.

In use, the slide 15 is mounted to the wall 12 and the bracket 14 is temporarily secured to a position on the slide.

The user decides in respect of what sort of club he is proposing to simulate the swing. Each club has a characteristic "lie angle", i.e. angle between the shaft and the ground when addressing the ball, and a characteristic standing height, i.e. vertical height from the top of the handle to the ground when addressing the ball. The part 16 is then adjusted relative to the bracket so that the axis 26 makes a suitable angle $\alpha$ with the horizontal. This determines the plane of the swing. The setting at 36 between the connecting elements 21,23 can then be adjusted to give the appropriate "lie angle" for the club in question, with the equipment hanging in the rest position as shown. The effective length of the arm 20 can also be adjusted to suit the user. This determines the radius of the swing, and will depend largely upon the user's arm length. This radius could additionally or alternatively be adjusted by an angular adjustment between the arm 20 and the axis 26 if provided for, but this would have to be done before adjusting at 36 as it would affect the lie angle. Finally, the position of the bracket on the slide is adjusted to give the correct standing height for the handle at the rest position shown. By correct adjustment of the various components of the device in this way, a swing closely approximating to the ideal for the user can be determined. By applying a normal golf club grip to the handle the user may proceed to swing as though making a normal golf stroke. The simulator thereafter allows the said predetermined swing to be practised in a relatively confined space and at the convenience of the user.

Another feature of the device shown is that the use of the crank 22 enables the handle 10 to be held so that the axis 28 passes through the hands. The connection 30 enables the handle to be rotated about the axis 28, allowing the hands to be cocked and uncocked in the approved manner. Connection 32 allows the handle 10, and therefore the hands of the user, to rotate about the axis 34 of the handle, and if desired a finger 35 can be provided at right angles to the handle to show the angular position of the club head during the swing.

As a modification of the device, the handle 10 could be axially slidable on a central spindle to allow the hands to move along the axis 34 during the swing. It would be returnable to its normal position by a compression spring 37.

It will be seen that the apparatus of the invention provides three rotational A,B,C modes about the axes 26,28 and 34 respectively, and preferably four adjustments D, E, F, G at the slide 15, the pivot pin 18, in the effective length of the arm 20, and at the pivot pin 36 respectively. The rotational mode A about axis 26 provides the basic swing. The rotational mode B about the axis 28 allows the hands to cock. The rotational mode C about the axis 34 allows the club to rotate about its axis, as it will naturally tend to do in the course of a normal swing, as can be seen from the attitude of the club head. Adjustment D finally sets the standing height; adjustment E determines the plane of swing; adjustment F determines the radius of swing; and adjustment G determines the lie angle. Apparatus could be provided having just the three pivotal modes and no adjustments, the apparatus being designed for a specific club and for a specific user with a specific swing. However, to be more commercially attractive one or more of the adjustments are preferably provided, so that the apparatus can be employed by different users or to simulate the use of different clubs. Any or all of the adjustments may be provided with graduations or other markings so that an established setting can be noted and subsequently found again without elaborate measurements or trial and error experiments. A chart can be provided to relate the markings to the types of clubs, plane of swing, and physical dimensions of the user.

Figure 2:
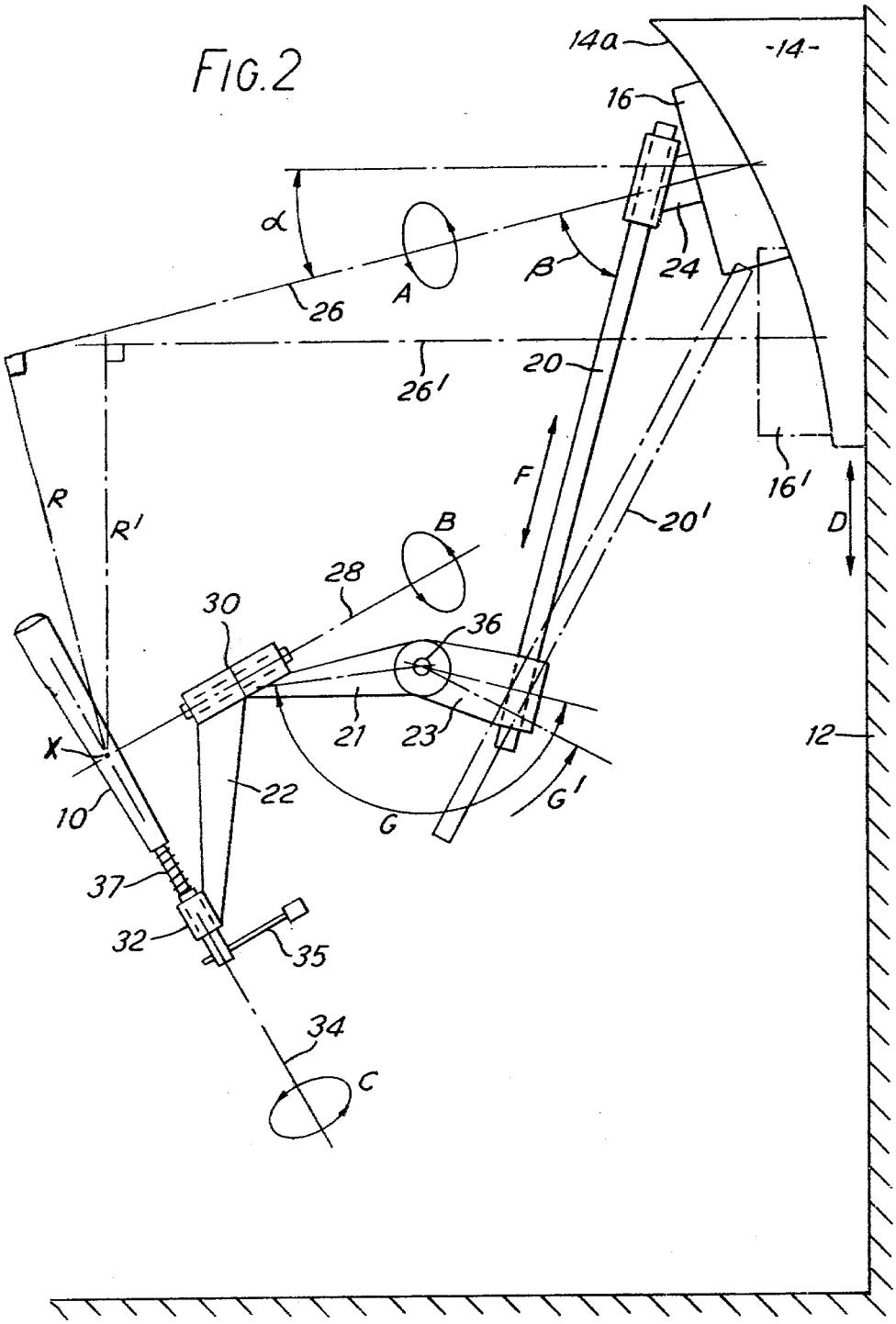
FIG. 2 shows a diagrammatic side view of a second embodiment of the device.

Referring to FIG. 2; instead of the part 16 being pivotally mounted to the bracket 14, the part 16 can take the form of a block which is securable, by screws or the like (not shown), at a variety of different positions on a concave curved surface 14*a* of a part 14. The part 14 is mounted to the support 12, either directly or through an intermediate part such as a slide 15 (as in FIG. 1). The effect of this modification can be seen from FIG. 2. By moving the part 16 up or down the curved surface 14*a* the angle $\alpha$ which the axis 26 makes with the horizontal changes; i.e. the plane of swing changes. With the apparatus of FIG. 1, changing the plane of swing by pivoting the part 16 about the axis 18 will result in a substantial raising or lowering of the handle 10. In the embodiment of FIG. 2, however, the raising and lowering of the part 16 to effect the change of plane of swing can compensate partly or wholly for this and leave the handle in more or less the same place, so that some of the remaining adjustments are much less than would otherwise be the case. FIG. 2 shows in dot-dash lines the position at one extreme where the plane of swing is vertical; i.e. $\alpha=0$. Primed reference numbers are used in relation to this new position. The axis of swing has now moved to the horizontal position 26' and the block has moved to position 16' on the surface 14*a*. Adjustment at pivot 36 is made to reduce the angle G to G' so that the lie angle of the club remains the same. The radius of swing R can be taken as the perpendicular from the point X of intersection of the axes 28 and 34 to the axis 26. The element 23 is moved up the arm 20' to restore the radius of swing R' to the same value as R. In doing so, because of the arrangement of the curve 14*a*, the handle moves back to approximately its original height. Thus little or no adjustment D of the height of the part 14 relative to the support 12 may be needed.

The handle can be adapted at its lower end for attachment thereto of detachable and interchangeable club shafts and heads, so that the user can have the feeling of swinging an actual club. Alternatively, instead of a permanent handle 10, there may be provided, rotatable about the axis 34, a clamp or other device for mounting a real golf club. However, a further useful feature of this invention is that the device can be more robust than many previously proposed devices. A good deal of stress is applied to the device during use, but by using only a handle and not an entire club the stress is considerably lessened. Also, especially with the arrangement of FIG. 2, a very firm yet adjustable mounting to the support can be achieved.

I claim:

1. A golf swing simulator device comprising a handle (10) or mounting for a handle representing that of a golf club, attachment means (14,15,16) for mounting the device to a stationary support (12), and a linkage connecting the handle with the attachment means, the linkage comprising an arm (20) pivotally mounted at one end (24) to the attachment means (16) about a first axis (26), the arm extending away from said axis (26) so that on pivoting the other end of the arm describes a circle about said first pivot axis (26), a crank (22) one end of which is connected with said other end of the arm through a pivotal connection (30) having a second axis of rotation (28) spaced from said first axis (26) and the other end of which is rotatably mounted to the handle (10) about the longitudinal axis (34) of the handle so that the handle projecting from the crank is spaced from said pivotal connection (30) in line with said second axis (28), means for adjusting the effective length of the arm (20) or the angle between the arm and the first axis (26), means (18;14*a*) for adjustment of the angle ($\alpha$) that said first pivot axis (26) makes with the horizontal, characterised in that the device includes means (36) whereby the angle between said first and second axes (26,28) can be adjusted.

2. A golf swing simulator device according to claim 1 wherein the attachment means includes a first part (15)

for attachment to a said support (12), and a second part (14) vertically adjustably mounted to the first part and with which the arm (20) is pivotally connected.

3. A golf swing simulator device according to claim 1 wherein the means for adjusting the angle ($\alpha$) that said first pivot axis (26) makes with the horizontal comprises a first part (16) with which the arm (20) is pivoted and a second part (14) mountable to the support (12) and having a curved surface (14*a*) which is curved in vertical profile and to which the first part (16) is securable at a variety of positions, whereby the angle ($\alpha$) of said first axis (26) increases and decreases as the first part (16) is raised and lowered respectively on said surface (14*a*).

4. A golf swing simulator according to claim 3 wherein the second part (14) is vertically adjustable relative to the support (12).

5. A golf swing simulator according to claim 1 including a said handle (10) terminating at or shortly below the region of its pivotal attachment to the crank (22).

6. A golf swing simulator according to claim 5 wherein the handle (10) terminates shortly below the region of its pivotal attachment to the crank (22), its downwardly projecting portion having a sideways projecting element (35) to represent the angular position of the club head.

7. A golf swing simulator device according to claim 1 wherein the angle ($\beta$) between the arm (20) and said first axis (26) is adjustable.

* * * * *